US008246051B1

(12) United States Patent
Nygaard

(10) Patent No.: US 8,246,051 B1
(45) Date of Patent: Aug. 21, 2012

(54) ELECTRONIC TENNIS SCORING DISPLAY

(76) Inventor: Kelly Heyward Nygaard, Washington, DC (US)

( * ) Notice: Subject to any disclaimer, the term of this patent is extended or adjusted under 35 U.S.C. 154(b) by 688 days.

(21) Appl. No.: 12/357,397

(22) Filed: Jan. 22, 2009

(51) Int. Cl.
*G06F 19/00* (2011.01)
*G08B 23/00* (2006.01)
*A63B 67/04* (2006.01)

(52) U.S. Cl. ..... 273/317; 273/317.4; 116/223

(58) Field of Classification Search ..... 273/317, 273/317.4; 116/223
See application file for complete search history.

(56) References Cited

U.S. PATENT DOCUMENTS

| | | | | | |
|---|---|---|---|---|---|
| 1,310,961 | A | * | 7/1919 | Osterberg | 235/113 |
| 1,985,652 | A | * | 12/1934 | Campbell | 235/114 |
| 3,246,411 | A | * | 4/1966 | Aafedt | 116/222 |
| 3,922,805 | A | * | 12/1975 | Krug | 40/533 |
| 4,045,788 | A | * | 8/1977 | Castelli et al. | 340/323 R |
| 4,097,855 | A | * | 6/1978 | Salvo | 340/323 R |
| 4,165,710 | A | * | 8/1979 | Gaetano | 116/223 |
| 4,237,372 | A | * | 12/1980 | Zevgolis et al. | 377/5 |
| 4,280,291 | A | * | 7/1981 | Maynes | 40/495 |
| 4,491,954 | A | * | 1/1985 | Genuit | 377/5 |
| 5,251,570 | A | * | 10/1993 | Creech | 116/225 |
| 5,385,113 | A | * | 1/1995 | Hierath | 116/222 |
| 5,615,636 | A | * | 4/1997 | Gustafson | 116/223 |
| 5,894,261 | A | * | 4/1999 | Green | 340/323 R |
| 6,052,054 | A | * | 4/2000 | Hampson et al. | 340/568.6 |
| 6,270,431 | B1 | * | 8/2001 | Martin | 473/459 |
| 6,378,232 | B1 | * | 4/2002 | Creech | 40/606.15 |
| 6,578,513 | B1 | * | 6/2003 | Niksich | 116/222 |
| 7,117,619 | B1 | * | 10/2006 | Huber | 40/495 |
| 2002/0067280 | A1 | * | 6/2002 | Carrillo et al. | 340/815.4 |
| 2008/0139344 | A1 | * | 6/2008 | Nally | 473/496 |
| 2010/0134383 | A1 | * | 6/2010 | Mele et al. | 345/1.3 |

FOREIGN PATENT DOCUMENTS

| | | | | |
|---|---|---|---|---|
| DE | 3201321 | A | * | 7/1983 |
| DE | 3206955 | A1 | * | 11/1983 |
| DE | 4204928 | A1 | * | 8/1993 |
| JP | 2000042160 | A | * | 2/2000 |
| JP | 2000061019 | A | * | 2/2000 |

* cited by examiner

*Primary Examiner* — Dmitry Suhol
*Assistant Examiner* — Jason Skaarup

(57) ABSTRACT

An electronic scoring display for tennis includes a display box connected to support pole affixed to a tennis net support post. The display box has identically opposed faces that include numeric light emitting diode displays for completed game scores and LED indicators for completed sets. Switches control each players completed game displays from 0 to 9 in a circular rotation. A switch controls both completed set indicator lights in a circular sequence of all possibilities. A switch reverses each players respective score information on the display.

9 Claims, 4 Drawing Sheets

ELECTRONIC TENNIS SCORING DISPLAY

BACKGROUND

1. Field of the Invention

Embodiments of the present invention relate to scoring systems and methods, more specifically, to a tennis scoring and display systems and methods.

2. Discussion of Related Art

Tennis courts used for play commonly have individual scoring devices attached to the net support posts. These devices display and record tennis match progress in sets and games for the competitors and surrounding viewers. Historically, these net mounted devices have all been manually operated by flipping printed cards to the desired numbers or placing tennis balls as markers for a respective score on a printed number pole.

Such flip card devices use a T-bar mounted by its vertical member on one of the net posts and two sets of numbered flip cards supported from the top cross members of the T-bar. Each flip card has a pair of small through-holes defined there through adjacent to the top edge of the card. Metal rings are extended through these holes and disposed over the top cross members so as to support the sets of flip cards below the respective cross members of the T-bar. The numbers are printed in sequence on both front and backsides of the flip cards. The cards must be flipped over until the correct numbers are exposed to post the score.

These flip card devices have several disadvantages. First, the flip cards are tedious to use. The user has to lift each card to see if the number being sought is displayed on the opposite side of the current number being displayed. This creates considerable fumbling around to find and post the correct score. Second, the printed numbers must be large enough to be viewed from a distance increasing the overall size of the device. Third, a high number of exposed moving parts. These parts are affected by weather, constant use, wear and tear as well as theft or vandalism. Fourth, the requirement of the whole unit to rotate as players change sides is subject to wear and tear and unwanted movement by wind. Fifth, the device must use four sets of cards to display the overall match score in sets and the current set score in games. Sixth, the projecting cross bars are hazardous to the players.

Other common devices for individual court scoring include U.S. Pat. No. 5,385,113 to Hierath (1995) and U.S. Pat. No. 6,578,513 B1 to Niksich (2003). These devices are comprised of elongated vertically disposed displays that rely on frictionally secured tennis balls corresponding to a score number.

These devices also have several disadvantages. First, The printed numbers must be large enough to be viewed from a distance and individually stacked upon each other increasing the overall size of the device. Second, the units cannot be rotated as players change sides so different colored numbers must be used to differentiate an individual's score confusing spectators without that knowledge. Third, the tennis balls used for marking require additional cost and effort to acquire and are subject to theft and deterioration from weather making the device aesthetically unpleasing. Fourth, to display an overall match score in sets requires additional markers and space on the display.

Scoring displays for individual courts such as those described above have all employed similar outdated characteristics to operate and perform. The progress of recent technology in the components that make up this display have led to a solution that reduces and eliminates many of the shortcomings of these net mounted devices.

Two electronic scoring devices which are not net mounted include U.S. Pat. No. 0,067,280 to Carrillo and Weiss (2002) and U.S. Pat. No. 4,237,372 to Zevgolis and Kitchen (1980).

The device by Carrillo and Weiss (2002) has several disadvantages. First, remote control units to input scores into the display operate the device. Requiring the competitors to hold remote control units as well as tennis balls can become problematic. The units are also subject to loss, theft, and breakage as well as requiring a power source.

Second, the device has a current game score display. This requires an input action via remote control by each competitor for every point played. Holding the remote control unit and making constant inputs is burdensome, tedious and disrupts the flow of play. The benefit of displaying the current game score is outweighed by the inherit problems of operation.

Third, the overall score of the match in completed sets is not represented on the display. The device only displays the amount of games won by a competitor in the current set. Displaying sets that have been completed is vital for the players and possible spectators.

Fourth, the display is mounted on the wall or placed on the ground. An individual court display cannot always be mounted on a wall at a club with multiple courts. A display placed on the ground reduces the viewing angle, is subject to theft and vandalism, and because the unit does not have identically opposed sides, viewers cannot view the score from the other direction.

Fifth, the device includes a match time indicator adding to the complexity and size of the device for information that is not vital for competitors and spectators. Sixth, as competitors change sides, all information has to be switched and reset in multiple steps.

The device by Zevgolis and Kitchen (1980) is an electronic display and the circuitry involved in recording scores for tennis. The device has a display for the current game score which has the identical disadvantages described above for Carillo and Weiss's (2002) patent. The device also does not display the completed set score. The device is meant to be worn on the wrist or belt which eliminates spectators form obtaining score information.

BRIEF SUMMARY

According to an aspect of the present invention, there is provided a tennis scoring and display device, including: a housing having a top side, a front side and an opposing rear side, a left side and an opposing right side; a right front numerical display and a left front numerical display disposed on the front side; a right rear numerical display and a left rear numerical display disposed on the rear side; and a right numerical display switch and a left numerical display switch both disposed on the top side, the switches sequentially switching the numeric displays so as to display numerical values from 1 to 9 in a repeating rotation, the right numeric display switch producing a desired number simultaneously on the right front and the right rear numerical displays, the left numeric display switch producing a desired number simultaneously on the left front and the left rear numerical displays.

According to yet another aspect of the present invention, there is provided a device with a housing, having: an information displaying section including four numerical displays, two on a front side of the housing, two on a rear side of the housing that opposes the front side, and two set lights on respective, opposing sides of the housing other than the front side and the rear side, and one of the front numerical displays and one of the rear numerical displays being a first set of displays, the other numerical displays being a second set of displays; and an information receiving section including a first numerical display switch and a second numerical display switch, the switches sequentially switching the numeric displays from 1 to 9 in a repeating rotation, the first numeric display switch producing a desired number simultaneously on the first set of numerical displays, the second numeric display switch producing a desired number simultaneously on the second set of numerical displays, the switches receiving scoring input by being selectively switched by a user, and a set light switch that selectively controls illumination of the set lights, successive switching of the set light switch causing the set lights to illuminate on and off in accordance with a specific, repeating sequence.

According to still another aspect of the present invention, there is provided a method of receiving and communicating a score of a tennis match, including: energizing a tennis match scoring device having a housing having a top side, a front side and an opposing rear side, a left side and an opposing right side, a right front numerical display and a left front numerical display disposed on the front side, a right rear numerical display and a left rear numerical display disposed on the rear side, a right numerical display switch and a left numerical display switch both disposed on the top side, the switches sequentially switching the numeric displays so as to display numerical values from 1 to 9 in a repeating rotation, the right numeric display switch producing a desired number simultaneously on the right front and the right rear numerical displays, the left numeric display switch producing a desired number simultaneously on the left front and the left rear numerical displays, a pair of set lights on the opposing right and left sides of the housing, the set including a first set light on the right side and a second set light on the left side, and a set light switch that selectively controls illumination of the right and left set lights, successive switching of the set light switch causing the set lights to illuminate on and off in accordance with a specific, repeating sequence, the sequence including all the possibilities of that could occur in a common best of three set tennis match; and receiving scoring data into the device by receiving selective switching the switches in accordance with the scoring in the tennis match so as to cause the device to display the score.

These, additional, and/or other aspects and/or advantages of the present invention are: set forth in the detailed description which follows; possibly inferable from the detailed description; and/or learnable by practice of the present invention.

DESCRIPTION OF DRAWINGS

The present invention will be more readily understood from the detailed description of embodiments thereof made in conjunction with the accompanying drawings of which.

LISTING OF REFERENCE NUMERALS

Figure 1:
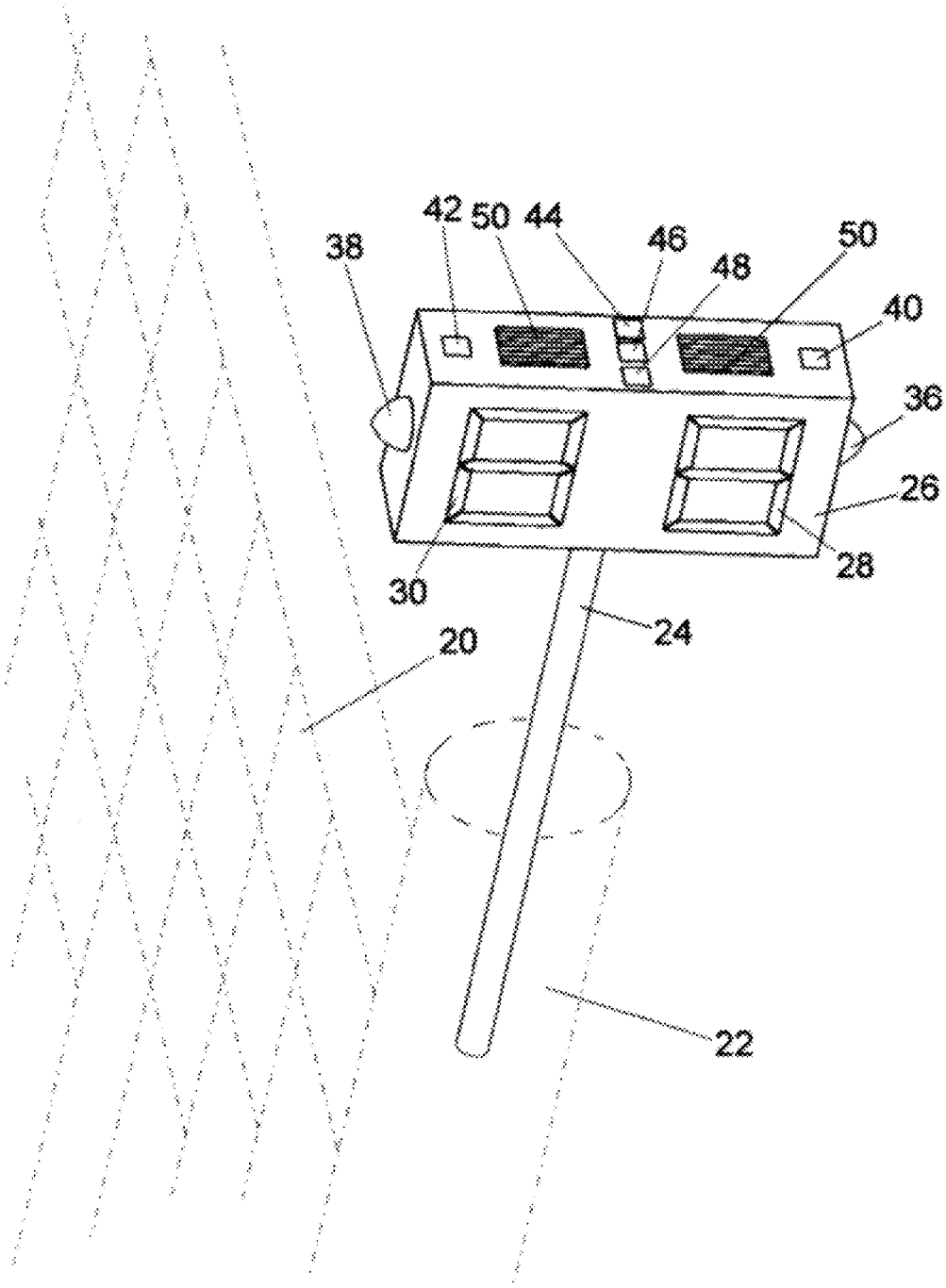
FIG. 1 is front perspective view of an electronic tennis scoring display consistent with an embodiment of the present invention.

20 tennis net
22 net support post
24 display support pole
26 display housing
28 front right numeric display
30 front left numeric display
32 rear right numeric display
34 rear left numeric display
36 right set light
38 left set light
40 right numeric display switch
42 left numeric display switch
44 on/off switch
46 set lights switch
48 score reversal switch
50 solar cells
52 power supply
54 right IC numerical sequencer
56 left IC numerical sequencer
58 IC set lights sequencer

DETAILED DESCRIPTION

Reference will now be made in detail to embodiments of the present invention, examples of which are illustrated in the accompanying drawings, wherein like reference numerals refer to the like elements throughout. The embodiments are described below to explain the present invention by referring to the figures.

Figure 2:
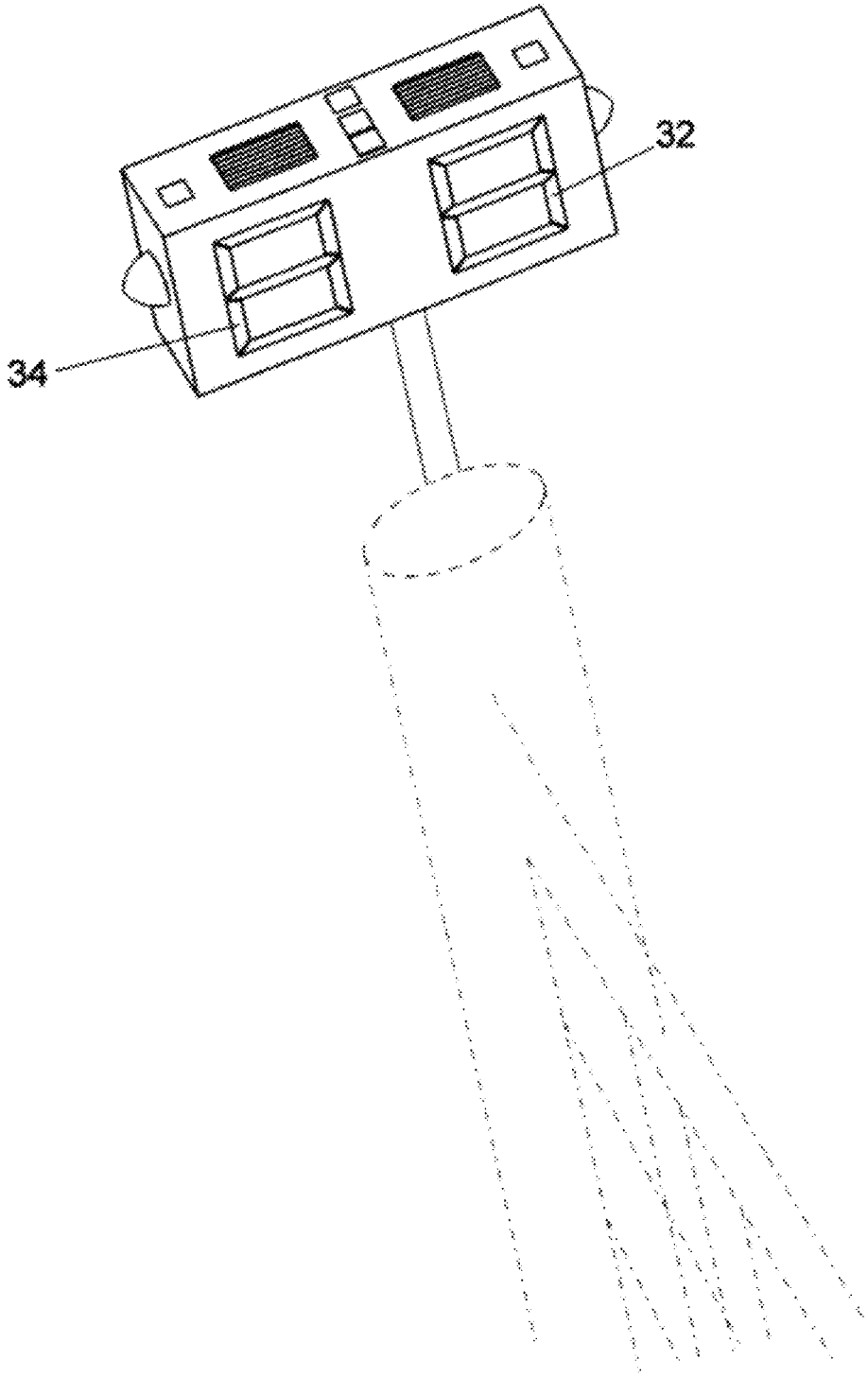
FIG. 2 is a rear perspective view of the electronic tennis scoring display of FIG. 1.

FIG. 1 is a perspective front view of an electronic tennis scoring display for displaying completed game amounts 28, 30 and completed set scores 36, 38 for a tennis match. FIG. 1 shows the display housing 26 connected to a display support pole 24 affixed to a tennis net 20 and net support post 22. I contemplate that the display support pole 24 be made of stainless steel to resist weather, but other materials are also suitable. The display housing 26 should be made of any material that is weather and waterproof. FIG. 2 shows a perspective rear view of the electronic tennis scoring display showing the rear completed game amounts 32, 34. FIGS. 1 and 2 show that the front and rear of the display are identically opposed.

The display housing 26 comprises the front right and left numeric displays 28, 30 (FIG. 1) and rear right and left numeric displays 32, 34 (FIG. 2). The display housing 26 also includes right and left set lights 36, 38 (FIG. 1), right and left numeric display switches 40, 42 (FIG. 1), the set lights switch 46 (FIG. 1), an on/off switch 44 (FIG. 1), solar cells 50 (FIG. 1) and a score reversal switch 48 (FIG. 1).

The numeric displays 28, 30, 32, 34 (FIGS. 1, 2) would be composed of any type of numerical display including, electromechanical, electromagnetic, dot matrix, light-emitting diode arrays (LEDs), liquid crystal displays (LCDs), plasma displays, etc. I contemplate using a seven-segment LCD but other displays not listed above could also be suitable. The set lights 36, 38 would be composed of any type of illuminated light source mimicking the output and intensity of the completed game displays 38, 36.

Figure 3:
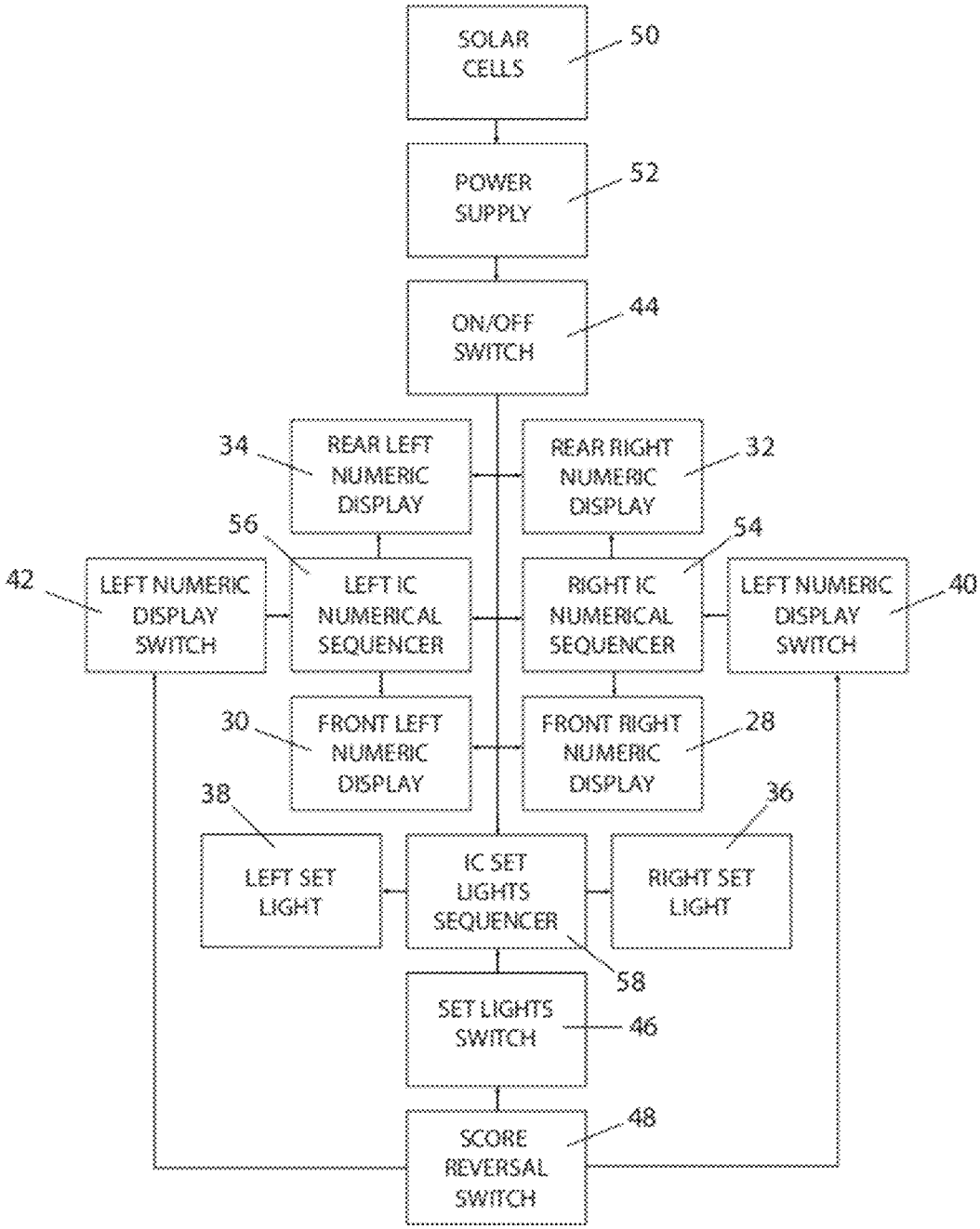
FIG. 3 is a block diagram of an electronics assembly of the electronic tennis scoring display of FIG. 1.

FIG. 3 shows a block diagram displaying the components of the electrical assembly. The diagram includes blocks for the numeric displays 28, 30, 32, 34, and right and left IC numerical sequencers 54, 56. Also included in FIG. 3 are the set lights 36, 38, and their IC set lights sequencer 58. Remaining blocks include the left and right numeric display switches 40, 42, on/off switch 44, set lights switch 46, score reversal switch 48, solar cells 50, and the power supply 52.

In operation, the electronic tennis scoring display is mounted by the display support pole 24 to a tennis net support post 22 and tennis net 20 (FIG. 1). The design of the display allows the scoring display to be permanently fixed with no external moving parts to complicate use, wear out, or be affected by weather, wind, vandalism or theft, as prior art has shown.

The display housing 26 (FIG. 1) is designed to encase all components of the display and be weather and waterproof. The numeric displays 28, 30, 32, 34 and the set lights 36, 38 (FIGS. 1, 2) indicate completed set and overall game scores for a tennis match. They are electrically illuminated components such as light emitting diodes (LEDs) that have the ability to be changed by touch button controls. This design increases overall visibility in a small display, while reducing manual operation.

FIG. 1 shows the right and left numeric display switches 40, 42. They are push buttons that sequentially switch the numeric displays 28, 30, 32, 34 (FIGS. 1, 2) from 1 to 9 in a circular rotation. The right numeric display switch 40 (FIG. 1) produces the desired number simultaneously on its two completed game displays 28, 34 (FIGS. 1, 2) located nearest to that player. The left numeric display switch 42 (FIG. 1) produces the desired number simultaneously on its two completed game displays 30, 32 (FIGS. 1, 2) located nearest to the other player. The result is the ability for anyone to distinguish the completed game scores for each player or team. The right and left IC numerical sequencers 54, 56 (FIG. 3) create the circular sequence 0-9 presented by the numeric displays 28, 30, 32, 34 (FIG. 1).

The set lights switch 46 (FIG. 1) is a push button that controls the right and left set lights 36, 38 (FIG. 1). Pushing this button will run a circular sequence of on and off positions of these lights according to how the players are progressing by sets in their tennis match. This sequence includes all the possibilities of what could occur in a common best of three set tennis match. The sequence is created by the IC set lights sequencer 58 (FIG. 3) and is as follows:

| | |
|---|---|
| Default | set lights 36, 38 dark; |
| One push | set light 36 lit, 38 dark; |
| Second push | set light 38 lit, 36 dark; |
| Third push | set lights 36, 38 both lit; and |
| Fourth push | return to default. |

FIG. 1 shows the score reversal switch 48. This push button reverses the score information on each side of the display for each player or team. The information for each player includes their respective numeric displays 28, 30, 32, 34 (FIGS. 1, 2) and their set lights 36, 38 (FIG. 1). As the players change sides one push of this button reverses all scoring for each player. Eliminating the rotation of the display reduces wear and tear issues, unwanted movement by wind, and theft.

The on/off switch 44 (FIG. 1) is a push button switch that turns the display on or off and in cases of inactivity the unit will turn itself off to conserve battery life. The power supply 52 (FIG. 3) could be achieved through any type of power or battery source including rechargeable or disposable batteries as well as common AC power. I contemplate using rechargeable alkaline batteries charged through solar cells 50 (FIG. 1) although other batteries would also be suitable.

Figure 4:
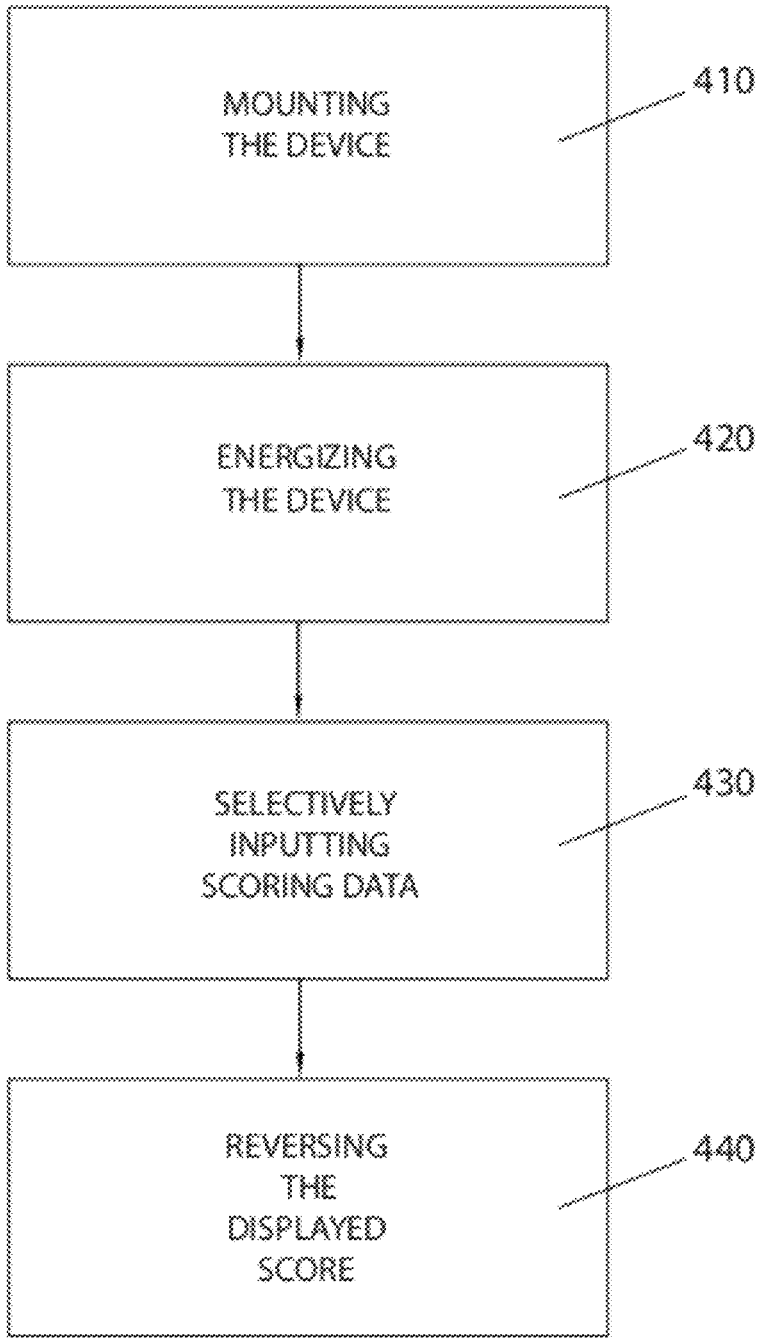
FIG. 4 is a flowchart illustrating a method consistent with an embodiment of the present invention.

Referring now to FIG. 4, a method 400 of receiving and communicating a score of a tennis match consistent with an embodiment of the present invention is illustrated. For ease of explanation only, this method will now be described with concurrent reference to FIGS. 1 and 2 and the device illustrated therein. It is to be understood, however, that this method may be practiced using other devices.

The method includes: mounting a tennis match scoring device 410; energizing a tennis match scoring device (operation 420); and selectively inputting data into the device (operation 430). Additionally and optionally, the method may also include reversing the score (operation 440).

In operation 410, the device is mounted to a post 22 on the net 20 of a tennis court by, for example, a pole 24.

In operation 420, user energizes (turns on) a device including: a housing 26, having a top side, a front side and an opposing rear side, a left side and an opposing right side; a right front numerical display 28 and a left front numerical display 30; a right rear numerical display 32 and a left rear numerical display 34; a right numerical display switch 40 and a left numerical display switch 42, the switches sequentially switching the numeric displays so as to display numerical values from 1 to 9 in a repeating rotation, the right numeric display switch producing a desired number simultaneously on the right front and the right rear numerical displays, the left numeric display switch producing a desired number simultaneously on the left front and the left rear numerical displays.

In operation 430, a user inputs scoring data into the device by selectively switching the switches in accordance with the scoring in the tennis match so as to cause the device to display the score.

In operation 440, the scoring information can be reversed when players switch sides on the tennis court during a match. To reverse the score, a user switches a score reversal switch 48 that reverses score information on each side of the display for each player, the score information being displayed on the numerical displays and the set lights 28, 30, 32, 34, 36, and 38.

As can be seen from the foregoing description of selected embodiments of the present invention, the present invention provides several advantages. For example, the invention may:

- provide an electronic, net mounted, tennis scoring display that displays only vital (essential) information in the simplest form to create the greatest of ease of use;
- provide a tennis score display that is easier to read and has a greater range of visibility of overall set score and current set score in games for players and spectators in a small display;
- provide a display with simple and easy to use touch button controls for the completed game score and completed set score;
- provide a display with no exposed or displaceable moving parts required for operation, resulting in a display resistant to wear and tear, weather, vandalism and theft;
- provide a display that is immobile and fixed which does not require rotating as players change sides, eliminating wind, theft, and wear and tear issues;
- provide a display with the overall match score in sets and games in a simple and efficient manner;
- provide a display with no projecting parts reducing player hazards; and/or
- provide a display that uses less space and less obtrusive to the players and grounds.

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

I claim:

1. A device with a housing, the device comprising:

an information displaying section including:

four numerical displays, two on a front side of the housing, two on a rear side of the housing that opposes the front side, and two set lights on respective, opposing sides of the housing other than the front side and the rear side, wherein one of the front numerical displays and one of the rear numerical displays forms a first set of displays and wherein the other front numerical display and the other rear numerical display form a second set of displays; and an information receiving section including:

a first numerical display switch and a second numerical display switch, the switches sequentially switching the numeric displays from 1 to 9 in a repeating rotation, the first numeric display switch producing a first desired number simultaneously on the first set of numerical displays, the second numeric display switch producing a second desired number simultaneously on the second set of numerical displays, the first and second numerical display switches being selectively switched by scoring input received from a user, and a set light switch disposed on the housing, the set light switch operable to selectively control illumination of the two set lights, wherein the set light switch is switchable to:

(i) a default state, wherein both of the two set lights are not illuminated, (ii) a first state, wherein one of the set lights is illuminated and the other of the set lights is illuminated, (iii) a second state, wherein the set light illuminated in the first state is not illuminated and the set light not illuminated in the first state is illuminated, and (iv) a third state, wherein both of the two set lights are illuminated, wherein successive inputs of the set light switch cause the set light switch to switch between the default state, the first state, the second state, and the third state for selectively illuminating the two set lights on and off in accordance with a specific, repeating sequence such that:

(i) if the set light switch is in the default state, a first input of the set light switch causes the set light switch to switch from the default state to the first state, (ii) if the set light switch is in the first state, a second input of the set light switch causes the set light switch to switch from the first state to the second state, (iii) if the set light switch is in the second state, a third input of the set light switch causes the set light switch to switch from the second state to the third state, and (iv) if the set light switch is in the third state a fourth input of the set light switch causes the set light switch to switch from the third state to the default state.

2. A tennis scoring and display device, the device comprising:

a housing having a top side, a front side, a rear side opposing the front side, a left side, and a right side opposing the left side;

a right front numerical display and a left front numerical display both disposed on the front side of the housing;

a right rear numerical display and a left rear numerical display both disposed on the rear side of the housing;

a right numerical display switch and a left numerical display switch both disposed on the top side of the housing, the right numerical display switch sequentially switching the right front and left rear numeric displays to display numerical values from 1 to 9 in a repeating rotation, the right numeric display switch producing a first desired number simultaneously on the right front and the left rear numerical displays, the left numerical display switch sequentially switching the left front and right rear numeric displays to display numerical values from 1 to 9 in a repeating rotation, the left numeric display switch producing a second desired number simultaneously on the left front and the right rear numerical displays;

a right set light disposed on the housing:

a left set light disposed on the housing; and a set light switch disposed on the top side of the housing the set light switch operable to selectively control illumination of the right and left set lights, wherein the set light switch is switchable to:

(i) a default state, wherein the right and left set lights are not illuminated, (ii) a first state, wherein the left set light is illuminated and the right set light is not illuminated, (iii) a second state, wherein the right set light is illuminated and the left set light is not illuminated, and (iv) a third state, wherein the right and left set lights are illuminated, wherein successive inputs of the set light switch cause the set light switch to switch between the default state, the first state, the second state, and the third state for selectively illuminating the right and left set lights on and off in accordance with a specific, repeating sequence such that:

(i) if the set light switch is in the default state, a first input of the set light switch causes the set light switch to switch from the default state to the first state, (ii) if the set light switch is in the first state, a second input of the set light switch causes the set light switch to switch from the first state to the second state, (iii) if the set light switch is in the second state, a third input of the set light switch causes the set light switch to switch from the second state to the third state, and (iv) if the set light switch is in the third state, a fourth input of the set light switch causes the set light switch to switch from the third state to the default state.

3. The device of claim 2, wherein each of the right front, right rear, left front and left rear numeric display includes at least one electromechanical display, electromagnetic display, dot matrix display, light-emitting diode array, liquid crystal display, and plasma display.

4. The device of claim 2, wherein each of the right front, right rear, left front and left rear numeric displays include a seven-segment liquid crystal display.

5. The device of claim 2, wherein each of the right front, right rear, left front and left rear numerical displays are selectively operable to communicate one of a plurality match scores possible in a best of three set tennis match, and wherein the right and left set lights are selectively operable to communicate one of a plurality set scores possible in the best of three set tennis match.

6. The device of claim 2, wherein the right set light is disposed adjacent to the right front numerical display and the left rear numerical display, and wherein the left set light is disposed adjacent to at least one of the left front numerical display and the right rear numerical display.

7. The device of claim 2, further comprising a score reversal switch disposed on the housing, the score reversal switch operable to reverse score information displayed by: (i) the right front and left front numeric displays, (ii) the right rear and left rear numeric displays, and (iii) the right and left set lights.

8. A method of receiving and communicating a score of a tennis match, comprising:

(a) energizing, with a power supply, a tennis match scoring device, the tennis match scoring device including:

(i) a housing having a top side, a front side, a rear side opposing the front side, a left side, and a right side opposing the left side;

(ii) a right front numerical display and a left front numerical display both disposed on the front side of the housing;

(iii) a right rear numerical display and a left rear numerical display both disposed on the rear side of the housing;

(iv) a right numerical display switch disposed on the top side of the housing, the right numerical display switch sequentially switching the right front and left rear numeric displays to display numerical values from 1 to 9 in a repeating rotation;

(v) a left numerical display switch disposed on the top side of the housing, the left numerical display switch sequentially switching the left front and right rear numeric displays to display numerical values from 1 to 9 in a repeating rotation;

(vi) a right set light disposed on the right side of the housing;

(vii) a left set light disposed on the left side of the housing; and (viii) a set light switch disposed on the top side of the housing, the set light switch operable to selectively control illumination of the right and left set lights, wherein the set light switch is switchable to:

(A) a default state, wherein the right and left set lights are not illuminated (B) a first state, wherein the left set light is illuminated and the right set light is not illuminated, (C) a second state, wherein the right set light is illuminated and the left set light is not illuminated, and (D) a third state, wherein the right and left set lights are illuminated;

(b) receiving, via the right numerical display switch, successive inputs which cause the right front numerical display and the left rear numerical display to simultaneously display the first desired number, wherein the first desired number indicates the score associated with a player of the tennis match; and (c) receiving, via the left numerical display switch, successive inputs which cause the left front numerical display and the right rear numerical display to simultaneously display the second desired number, wherein the second desired number indicates the score associated with a different player of the tennis match; and (d) receiving, via the set light switch, successive inputs which cause the set light switch to switch between the default state, the first state, the second state, and the third state for selectively illuminating the right and left set lights on and off in accordance with a specific, repeating sequence, such that:

(i) if the set light switch is in the default state, a first input received via the set light switch causes the set light switch to switch from the default state to the first state, (ii) if the set light switch is in the first state, a second input received via the set light switch causes the set light switch to switch from the first state to the second state, (iii) if the set light switch is in the second state, a third input received via the set light switch causes the set light switch to switch from the second state to the third state, and (iv) if the set light switch is in the third state, a fourth input received via the set light switch causes the set light switch to switch from the third state to the default state.

9. The method of claim 8, wherein the tennis match scoring device further includes a score reversal switch disposed on the housing, and wherein the method further comprises receiving, via the score reversal switch, input to reverse score information displayed by: (i) the right front and left front numeric displays, (ii) the right rear and left rear numeric displays, and (iii) the right and left set lights.

* * * * *